US007770496B2

(12) United States Patent
Chase et al.

(10) Patent No.: US 7,770,496 B2
(45) Date of Patent: Aug. 10, 2010

(54) EXTENSION APPARATUS FOR HARDWARE AND TOOLS

(76) Inventors: Christian W. Chase, 647 Bordeaux Dr., Petaluma, CA (US) 94954; Leslie S. Chase, 647 Bordeaux Dr., Petaluma, CA (US) 94954

( * ) Notice: Subject to any disclaimer, the term of this patent is extended or adjusted under 35 U.S.C. 154(b) by 94 days.

(21) Appl. No.: 11/921,426

(22) PCT Filed: May 31, 2006

(86) PCT No.: PCT/US2006/020922

§ 371 (c)(1),
(2), (4) Date: Nov. 30, 2007

(87) PCT Pub. No.: WO2006/130590

PCT Pub. Date: Dec. 7, 2006

(65) Prior Publication Data

US 2009/0031503 A1 Feb. 5, 2009

(51) Int. Cl.
*B25B 13/06* (2006.01)

(52) U.S. Cl. ..... 81/124.2; 7/128

(58) Field of Classification Search ..... 81/124.2, 81/180.1, 184, 901, 125, 52, 53.1, 13; 7/128; 294/19.1, 158; 324/200, 228
See application file for complete search history.

(56) References Cited

U.S. PATENT DOCUMENTS

| | | | | | |
|---|---|---|---|---|---|
| 2,231,323 | A * | 2/1941 | Cawood | 81/73 |
| 4,225,108 | A * | 9/1980 | Jaroche | 248/544 |
| 4,689,881 | A * | 9/1987 | Fall | 29/813 |
| 5,251,519 | A * | 10/1993 | Lang | 81/177.2 |
| 5,553,905 | A * | 9/1996 | Bentivegna | 294/24 |
| 6,000,080 | A * | 12/1999 | Anderson et al. | 7/128 |
| 6,026,715 | A * | 2/2000 | Hu | 81/176.3 |
| 6,101,905 | A * | 8/2000 | Hu | 81/125 |
| 6,145,851 | A * | 11/2000 | Heber | 279/143 |
| 6,289,541 | B1 * | 9/2001 | Anderson et al. | 7/128 |
| 6,485,031 | B2 * | 11/2002 | Chen | 279/83 |
| 6,601,254 | B1 * | 8/2003 | Walz | 7/128 |
| 6,643,877 | B1 * | 11/2003 | Amtenbrink et al. | 7/125 |
| 6,652,013 | B1 * | 11/2003 | Peterson | 294/19.1 |
| 6,786,116 | B2 * | 9/2004 | Dockery | 81/177.1 |
| 6,820,522 | B2 * | 11/2004 | Hu | 81/176.3 |
| 6,854,364 | B1 * | 2/2005 | Tassano et al. | 81/121.1 |
| 6,978,503 | B2 * | 12/2005 | Del Cogliano | 7/143 |
| 2002/0020023 | A1 * | 2/2002 | Anderson et al. | 7/128 |
| 2005/0184541 | A1 * | 8/2005 | Grizzle | 294/19.1 |
| 2006/0150340 | A1 * | 7/2006 | Yale et al. | 7/128 |

* cited by examiner

*Primary Examiner*—David B Thomas
(74) *Attorney, Agent, or Firm*—Larry D. Johnson

(57) ABSTRACT

A device that enables a user to install most any hardware item into any structure. The inventive apparatus includes a core portion with a standard female ACME thread so the core may be threaded onto a standard extension pole. At the upper end of the core is a cavity designed to accept wafers for various purposes. Hardware installing wafers are designed to accept pieces of hardware in a particular class and size such as eyebolts, hooks, right-angle hooks, and other suspension hardware. Tool wafers are wafers with various tools attached to them for performing different operations such as prying, lifting, nailing, tacking, threading, scrapping, grasping, cutting, drilling, marking, hole punching, and so on. Attachment wafers attach various implements and devices to the core.

9 Claims, 5 Drawing Sheets

EXTENSION APPARATUS FOR HARDWARE AND TOOLS

BACKGROUND OF THE INVENTION

1. Technical Field

The present invention relates generally to hardware and tools, and more particularly to an improved extension apparatus for hardware and tools.

2. Background Art

U.S. Pat. No. 6,283,519 to Dutton, et al. discloses a lighting rod and method. A lighting rod has a reach rod that is preferably nonconductive and has a holder hook on a hook end and a hook releaser on a handle end. The holder hook spring-grasps cords or lines against a rod tip by spring pressure of a hook spring on or in the reach rod. The hook releaser has a release member that contacts a hook base for releasing spring pressure on the holder hook. At least one channel in the rod tip receives an open end of the holder hook to allow tight retainment of a cord, line or other item positioned in the holder hook. An attachment-hook groove in the rod tip can be provided to receive a hook portion of an attachment hook for containing the attachment hook rigidly while a threaded portion of the attachment hook is being screwed into material by rotation of the reach rod for screwing attachment hooks into and out of the material. The holder hook and the rod tip can be structured to contain a wide selection of items.

U.S. Pat. Nos. 6,467,823 and 6,487,765 to Brekken describe a device for the installation and removal of a wire at an elevated location. The tool comprises a body having a top portion within which is formed a generally U-shaped notch with a width and depth that are much larger than the diameter of the wire to be handled. The sides of the notch are outwardly tapered so that the notch is wider at its top. All edges of the notch are smoothed and have a radius such that there is no binding of the wire onto the tool. The design of the tool allows the wire to easily slip across the bottom of the notch without binding. The lower portion of the cylinder comprises a concentric bore for receiving a pole or other lifting device.

U.S. Pat. No. 6,685,151 to Vasquez, et al. teaches a ladderless method for decorating or attaching objects, such ornamental light strings, misting systems and the like, to surfaces of a three-dimensional object. The method uses specially designed clips and obviates the need to use a ladder when attaching the linear systems to hard to reach locations.

U.S. Pat. No. 6,827,379 to Hill, et al. discloses a quick mounting clip system for hanging decorations and Christmas lights in the form of an apparatus for deploying decorative wiring upon elevated locations. The apparatus, packaged in kit form, utilizes a pole for installing wiring from a stable ground position. An installation nut screws unto the pole for manipulating accessory tools that deploy the clips and wiring. The nut comprises captivating slots to which a clip controller and wire tool are alternately coupled. A prong projecting from the controller forcibly engages the wiring clips. After clip installation, wires are installed with the wire tool's arms. The controller and wire tool both comprise flexible legs fitted within the nut slots that are snap-fitted by detents. Each clip comprises a baseplate, and an outwardly angled cradle for holding wiring. The gutter clip has a projecting latch terminating in a gutter-engaging barb. The adhesively-backed clip is press fitted to the target. A control region formed between the cradle and the baseplate of each clip receives the controller prong.

U.S. Pat. No. 6,854,364 to Tassano, et al. describes a screw hook socket in the form of a tool comprising a drive shaft with a longitudinal axis and a socket attached to the drive shaft.

The socket includes a cavity having a substantially rectangular opening defined by a pair of parallel side walls of the first side length and a U-shaped wall having two parallel walls adjacent to the opening and a curved portion of the U-shaped wall opposite the opening. In this manner, the cavity is shaped to fit the contour of a typical screw hook such that the screw hook can be anchored to a wall or ceiling with relative ease because the screw hook will not rotate away from the longitudinal axis of the tool.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

DISCLOSURE OF INVENTION

The extension apparatus for hardware and tools of the present invention provides a device that enables a user to install most any hardware item such as a hook, eyebolt, tack, nail, screw or other fastening device into any structure such as a ceiling, overhead, rafter, eave or open truss, open framing, wall, or floor location without the use of a ladder, or reaching, moving heavy items out of the way, bending, stooping or kneeling. Furthermore, several tools for the device empower the user to not only install suspension or fastening devices in out of reach locations, but actually manipulate wire, cable, line, cord, strings of lights, hanging plants, streamers and other decorative items onto or through the pieces of hardware.

The inventive apparatus includes a core portion (made of plastic, metal, composites or other materials) which may be injection molded, cast or machined. At the bottom of the core is a standard female ACME thread so the core may be threaded onto a standard extension pole, broomstick, or other device providing reach. At the upper end of the core is a cavity designed to accept wafers for various purposes.

There are at least three general groups of wafers that may be inserted inside the core: hardware installing wafers, tool wafers, and attachment wafers. All wafers have a few common characteristics, such as loading rails so the wafer can be inserted into the core only one-way. Each wafer has a cavity on its back to accept the locking tab at the back of the core which is designed to secure the wafer in a specific position depending on which type of wafer it is. Each wafer can be identified by an embossment denoting its specific purpose and this identifier can be seen on any wafer whether it is loaded or out of the core.

Hardware installing wafers are designed to accept pieces of hardware in a particular class and size such as eyebolts, hooks, right-angle hooks, and other suspension hardware. Tool wafers are wafers with various tools attached to them for performing different operations such as prying, lifting, nailing, tacking, threading, scraping, grasping, cutting, drilling, marking, hole punching, and so on. Attachment wafers attach various implements and devices to the core.

An accessory could be any hardware, product, or device that is used in conjunction with the inventive apparatus, for example a messenger line allowing the user to thread line, cord, cable, rope or chain through eyebolts across a distance without the use of a ladder.

It is therefore an object of the present invention to provide a new and improved extension apparatus for tools and hardware.

It is another object of the present invention to provide a new and improved device that enables a user to install most any hardware item into any structure without the use of a ladder.

A further object or feature of the present invention is a new and improved device to install suspension or fastening devices in out of reach locations.

An even further object of the present invention is to provide a novel device to manipulate wire or line onto or through pieces of hardware.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the international, regional, and national patent office(s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

BEST MODE FOR CARRYING OUT THE INVENTION

Figure 1:
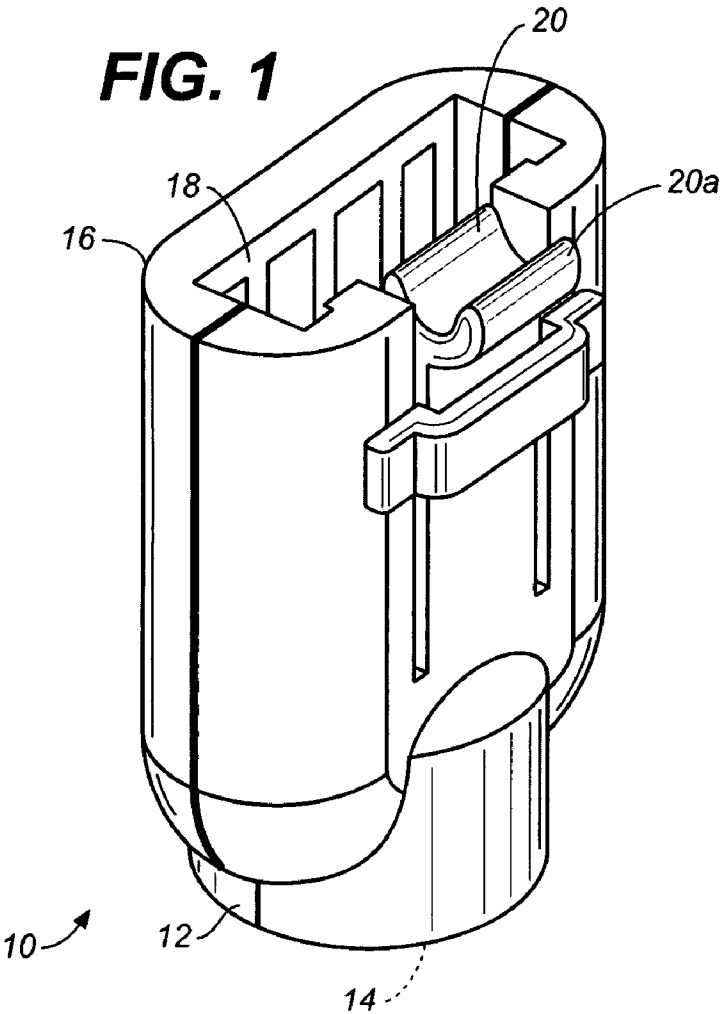
FIG. 1 is a rear perspective view of a core portion of an extension apparatus of the present invention.

Referring to FIGS. 1 through 10, wherein like reference numerals refer to like components in the various views, FIG. 1 is a rear perspective view of a core portion 10 of an extension apparatus of the present invention. The core portion 10 may be made of plastic, metal, composites or other materials, and may be injection molded, cast or machined. At the bottom 12 of the core 10 is standard female ACME thread 14 so the core may be threaded onto a standard extension pole, broomstick, or other device providing reach. At the upper end 16 of the core is a cavity 18 designed to accept wafers for various purposes. Locking tab 20 at the back of the core is designed to secure the wafer in a specific position depending on which type of wafer it is.

Figure 2:
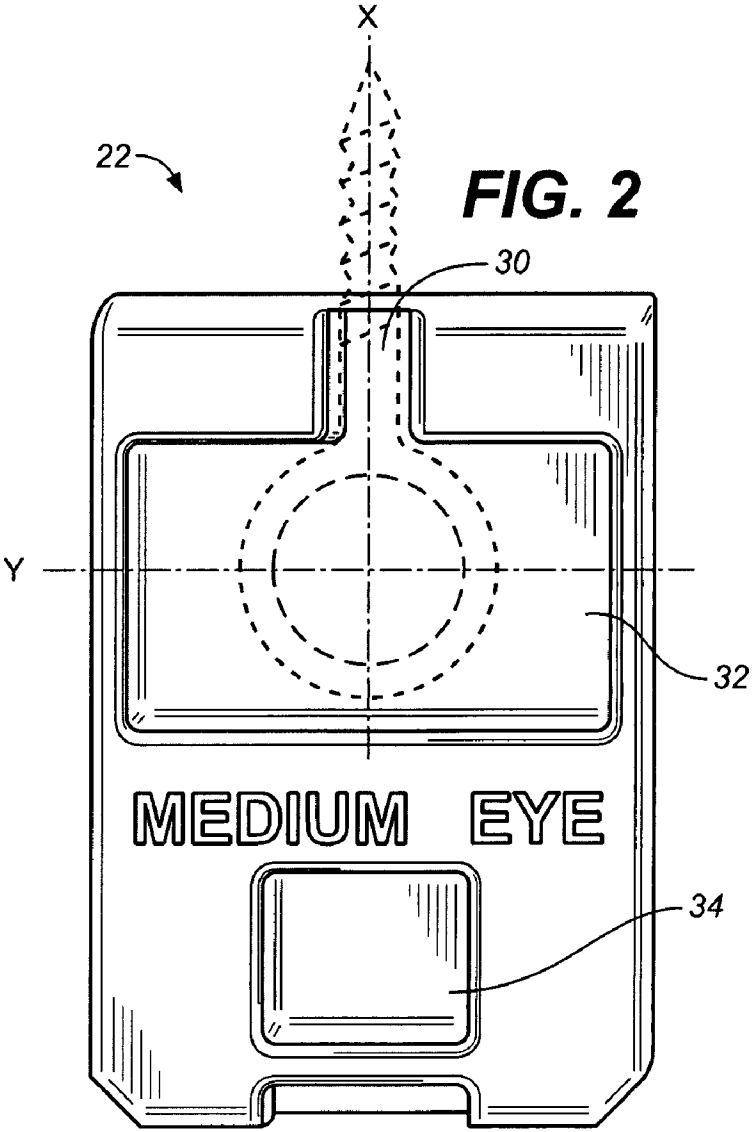
FIG. 2 is a view of a hardware installing wafer for eyelets.
Figure 4:
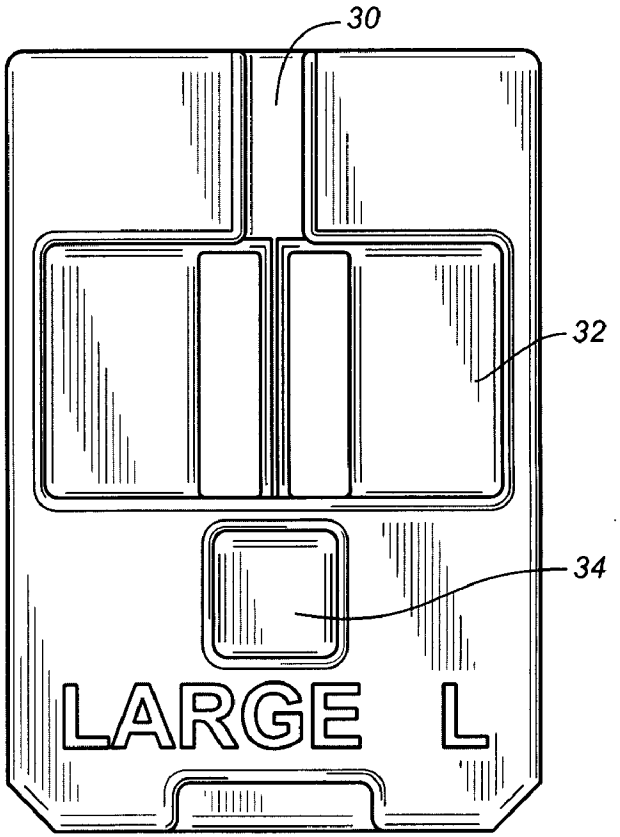
FIG. 4 is a view of a hardware installing wafer for L's.
Figure 3:
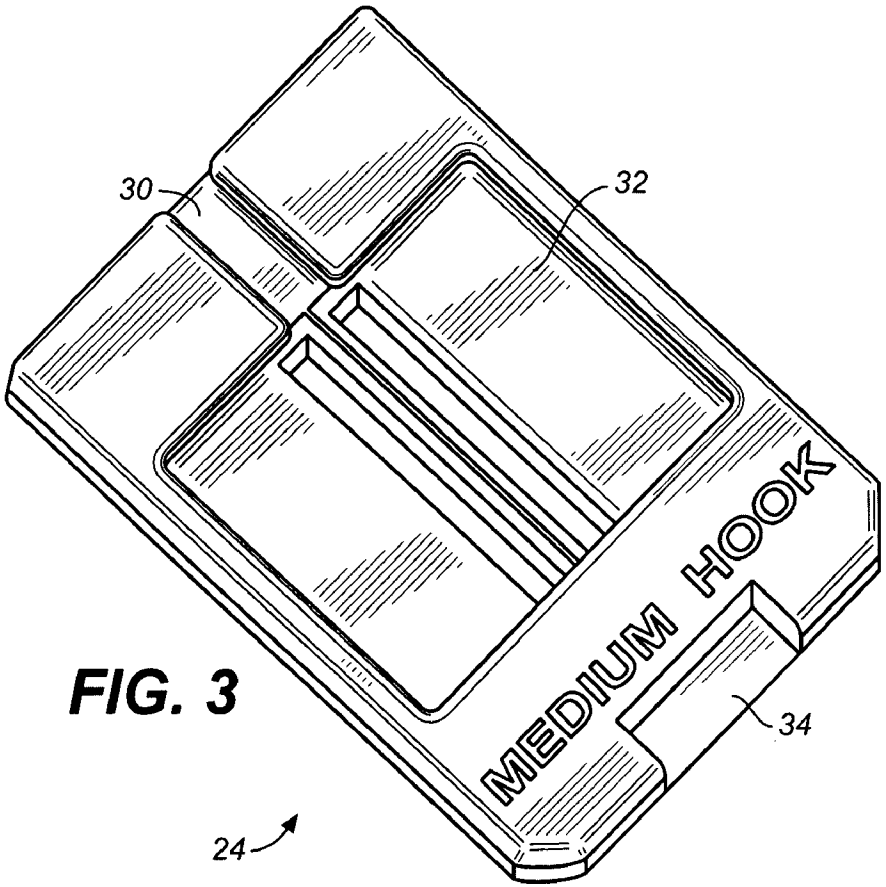
FIG. 3 is a view of a hardware installing wafer for hooks.
Figure 5:
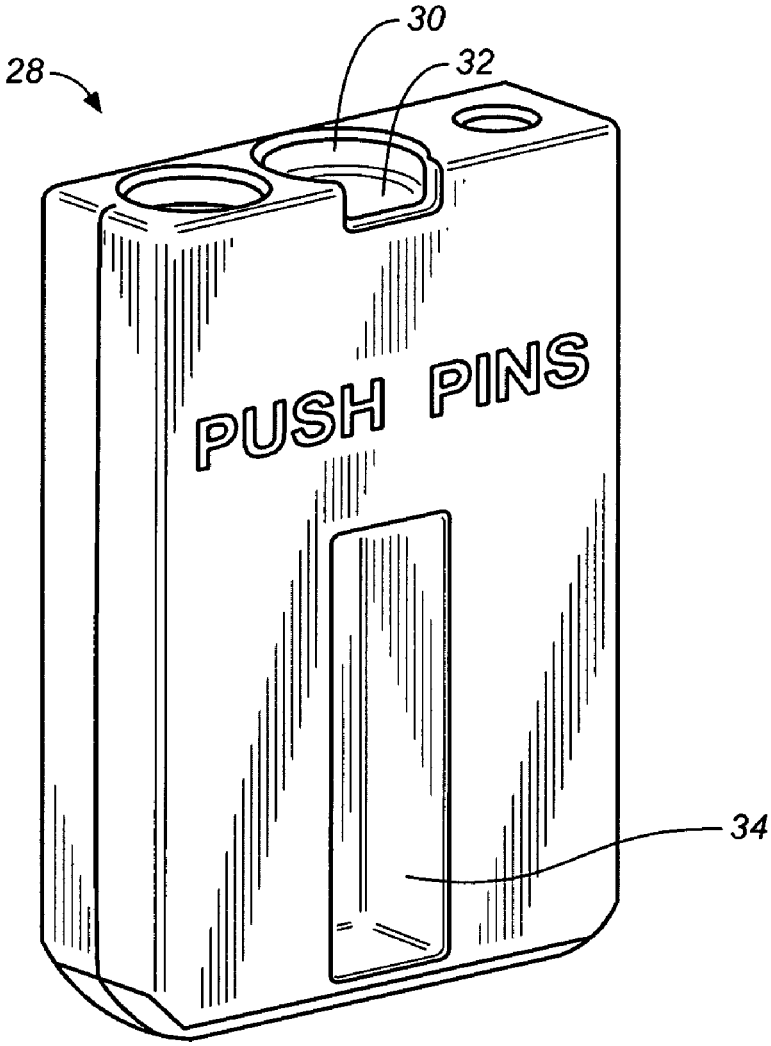
FIG. 5 is a view of a hardware installing wafer for push pins.

FIG. 2 is a view of a hardware installing wafer for eyelets 22; FIG. 3 is a view of a hardware installing wafer for hooks 24; FIG. 4 is a view of a hardware installing wafer for L's 26; and FIG. 5 is a view of a hardware installing wafer for push pins 28.

Hardware installing wafers are designed to accept pieces of hardware in a particular class and size such as eyebolts, hooks, right-angle hooks, and other suspension hardware. The wafer for a particular class of hardware is designed to hold that piece of hardware securely by restricting movement on two axes described for the purposes herein as the X-axis and the Y-axis. The X-axis is a choke point 30 where the shank of the eyebolt, hook, or other piece of hardware, fits in to. The Y axis is basically an open bed 32 in the center of the wafer where the actual eye, hook, or other geometric shape of various pieces of hardware rests but is not held securely until the hardware and its corresponding wafer are inserted together into the core wherein the inner wall of the core directly opposite the inserted piece of hardware and its corresponding wafer come into contact. It is by the action of this contact after insertion that the piece of hardware is held secure in its Y-axis.

The locking tab 20 at the back of the core interacts with the snap cavity 34 in the back of hardware installing wafers. All hardware installing wafers have a cavity 34 in back at the bottom designed to accept the locking tab 20 on the snap at the back of the core 10. The wafer is inserted into the core where the snap engages it and holds it secure in the open ready-to-load position. A corresponding piece of hardware is then placed into the wafer where it is held fast at its shank (X axis) and when the wafer and the hardware are inserted together into the core, the hardware is held fast on its Y axis preventing all lateral movement. It is important to note with hardware installing wafers that when the core's snap is engaged into the wafer, it prevents it only from pulling back out of the core unless the operator chooses to use the thumb release tab 20*a* to pull the snap back and release it. Otherwise, when the hardware installing wafer is engaged with the core's snap, it is held in open-ready-to-load position with most of its body exposed above the core for loading hardware. As an example, we shall describe an eyebolt being loaded and installed. The eyebolt's corresponding hardware installing wafer is snapped into the core in open-ready-to-load position. The eyebolt's eye is placed in the bed of the wafer and its shank is pressed into the choke point at the top of the wafer exposing the thread. Both the eyebolt and its wafer are then pressed down into the core completely securing the piece of hardware. As stated above, the snap is designed to hold the wafer in open-ready-to-load position preventing it only from backing out but the snap is designed with a bevel so that when the wafer and its corresponding piece of hardware are pressed into the core, the snap will slide up onto a runway in the back of the wafer and continue to rest on the wafer's back while it is inserted all the way into its resting position in the core. The user advances the core up to the installation surface and through turning action installs the eyebolt. When the user feels the eyebolt is threaded far enough into the installation surface, he/she gentle pulls downward, pulling the wafer partially out of the core until it re-engages with the snap back into the open-ready-to-load position; but in this case, it releases from the eyebolt and the operation is complete. The operator may lower the core and load another piece for continuous installations. This operation is identical for installing other sizes of eyebolts, hooks, right-angle hooks, and various other threaded fasteners. It is important to note that the inventive apparatus may accommodate and install whole ranges of different types of hardware and should not be limited in scope to the various types of hardware described herein.

Figure 6:
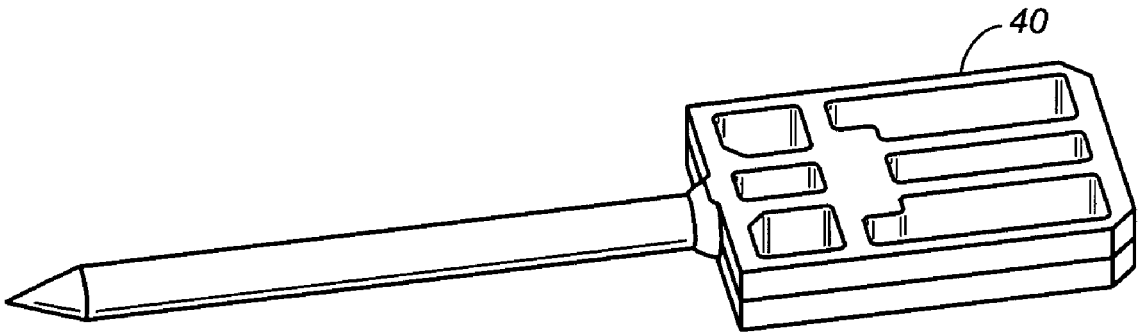
FIG. 6 is a view of a tool wafer for a hole starter.

FIG. 6 is a view of a tool wafer for a hole starter 40. Tool wafers contain all the same basis characteristics as hardware installing wafers: they are the same basic geometry. They only load into the core one-way. They have a cavity in back which accepts the locking tab on the snap at the back of the core. The basic differences are as follows: Tool wafers are wafers with various tools attached to them for performing different operations such as prying, lifting, nailing, tacking, threading, scraping, grasping, cutting, drilling, marking, hole punching, and so on. A key difference with the hardware installing wafers is that tool wafers are designed to slide all the way into the core before the core's snap engages the wafer. This is so when a tool wafer is inserted into the core, it is locked in tightly by the snap. The only way to release a tool wafer is manually by pressing on the thumb grip at the back of the core.

Operation is as follows, using a hole-starter tool wafer 40 as an example. The hole-starter tool wafer is fully inserted into the core until the snap engages. The operator advances the tool with the aid of an extension pole to the surface he/she desires to mark or make a starter hole in and presses the point of the tool firmly into the surface so as to make a mark or starting hole for some piece of hardware to be installed later. It is important to note, the inventive apparatus is capable of installing the largest pieces of hardware without the aid of any starter hole in most materials, but in materials with very hard surfaces, the hole-starter tool wafer may be employed. Again, it is stressed that any tool that can be attached to a wafer and operated is within the scope of this invention, and the tools mentioned herein are only examples.

Figure 8:
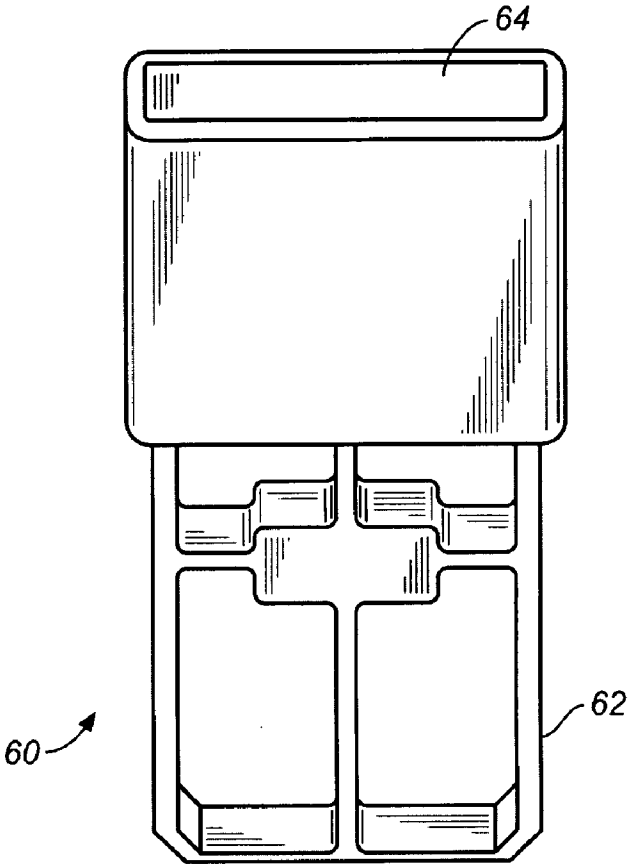
FIG. 8 is a view of an attachment wafer for an extractor.
Figure 7:
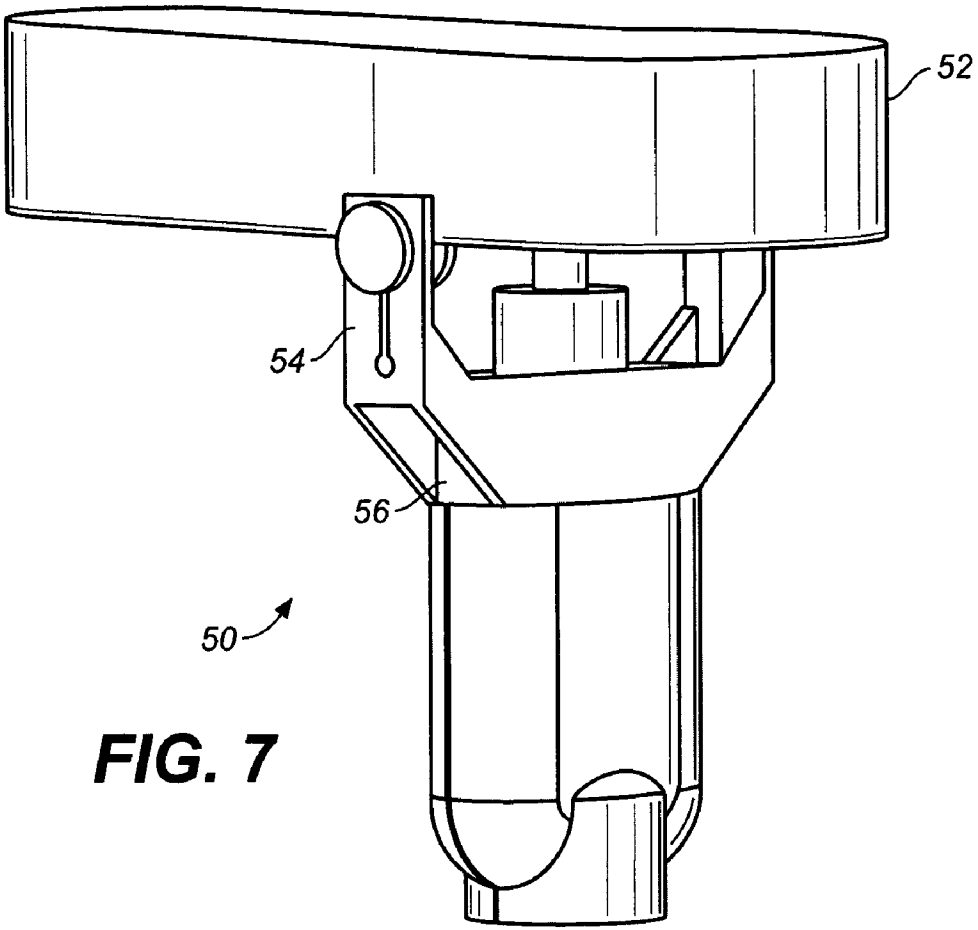
FIG. 7 is a view of an attachment wafer for a stud sensor.

FIG. 7 is a view of an attachment wafer for a stud sensor 50; while FIG. 8 is a view of an attachment wafer for an extractor 60.

Attachment wafers contain all the same basis characteristics as tool wafers: they are the same basic geometry. They only load into the core one-way. They have a cavity in back which accepts the locking tab on the snap at the back of the core. They load all the way into the core and lock firmly into position. Their purpose is to attach various implements and devices to the core. Just about any device one could think of may become an attachment wafer by producing the device with a wafer and possibly other geometric features allowing the device to be operated remotely with the use of extension poles.

The stud sensor attachment 50 enables any stud sensor to be attached to the inventive apparatus and operated through wafer technology. The basic components of the stud sensor attachment are the shoe 52, the pivot arm 54, and the attaching wafer 56. Various snaps and other devices may be employed as necessary to remotely operate the various stud sensors due to their different sizes and features. A particular description of how this would work follows: a typical handheld stud sensor fits into the plastic shoe of the attachment, which is attached to an armature with two arms that snap into pivots on each side of the shoe. The lower part of the armature is a wafer that attaches to the core. As stated above, attachment wafers lock into position only when fully inserted into the core. Operation is as follows: some stud sensors are activated with side buttons while others are activated by proximity with a surface (electronically sensing the surface and activating) or by way of a small switch which is depressed when the operator presses the stud sensor against the surface. Another feature of some stud sensors is an automatic marking feature. This is usually activated by a button on the top of the sensor after the sensor indicated the proper position where a fastening device should be installed. The stud sensor attachment may be designed with specific or adjustable geometry so the shoe accepts any type of hand held stud sensor. If a particular stud sensor is side button activated, a snap in the side of the shoe may be employed to depress this button and activate the device when it is advanced to the desired surface. Should the particular sensor activate by contact or proximity to the desired surface, a snap or switch is not required for the attachment. The operator simply places the sensor in the shoe and attaches the shoe and pivot arm to the apparatus and advances it to the desired surface. The final part of the stud sensing operation, obviously, is marking the desired position indicted by the sensor. With sensors that do not have features for automatically marking the position a marking device may be attached to front of the shoe in alignment with the center mark on the stud sensor. A slight tilt will bring the marking device in contact with the surface and mark it. In the case of stud sensors that feature a button in the top of the device that when depressed automatically mark the surface when the correct position is detected by the sensor, the pivot arm on the stud sensor attachment is fitted with a spring loaded post attached to the wafer at the base of the pivot arm so that when the operator inserts the sensor into the shoe, advances it to the desired surface, passes the sensor over the surface detecting a desired installation position, the operator then gently pushes upward on the assembled apparatus, advancing the spring loaded post through a hole in the center of the armature and the post contacts the marking button at the top of the sensor. The post is long enough to contact the button in any position the pivot arm adjusts to on the shoe. Another feature that may be added to the stud sensor attachment for automatic marking features is a bright red doping stick for dressing the marking needle that advances at the button of the stud sensor where it comes in contact with the desired surface.

The extractor attachment 60 actually extracts installed pieces of hardware as well as acts as an installer for some of the larger pieces of hardware, such as large swag hooks and very large eyebolts. The wafer portion 62 of the extractor attachment is identical in design to the tool wafers and the attachment wafers in that it snaps into position only when it is fully inserted into the core portion. The upper end 64 of the extractor is basically a cavity with walls wide enough to accept the largest eyebolt or hook the apparatus can install and yet small enough to fit over the smaller pieces of hardware and untwist them with a counter clockwise motion. In every case the piece of hardware being extracted will drop into the cavity once completely unthreaded from the surface it was threaded into. In the particular instances where the extractor is to be used to actually install items such as swag hooks or large eyebolts, it is generally recommended that a pilot or starter hole be made for harder surfaces utilizing one of the tool wafers, but with softer surfaces, such as sheetrock and plaster, the swag hook may be placed into the cavity with its threaded shank pointing up, and then advanced to the desired installation service and threaded in.

Figure 9:
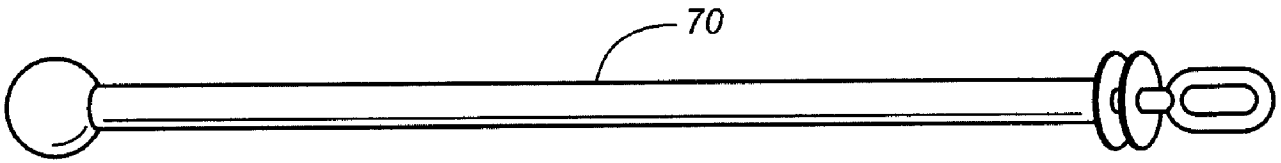
FIG. 9 is a view of a messenger line accessory.
Figure 10:
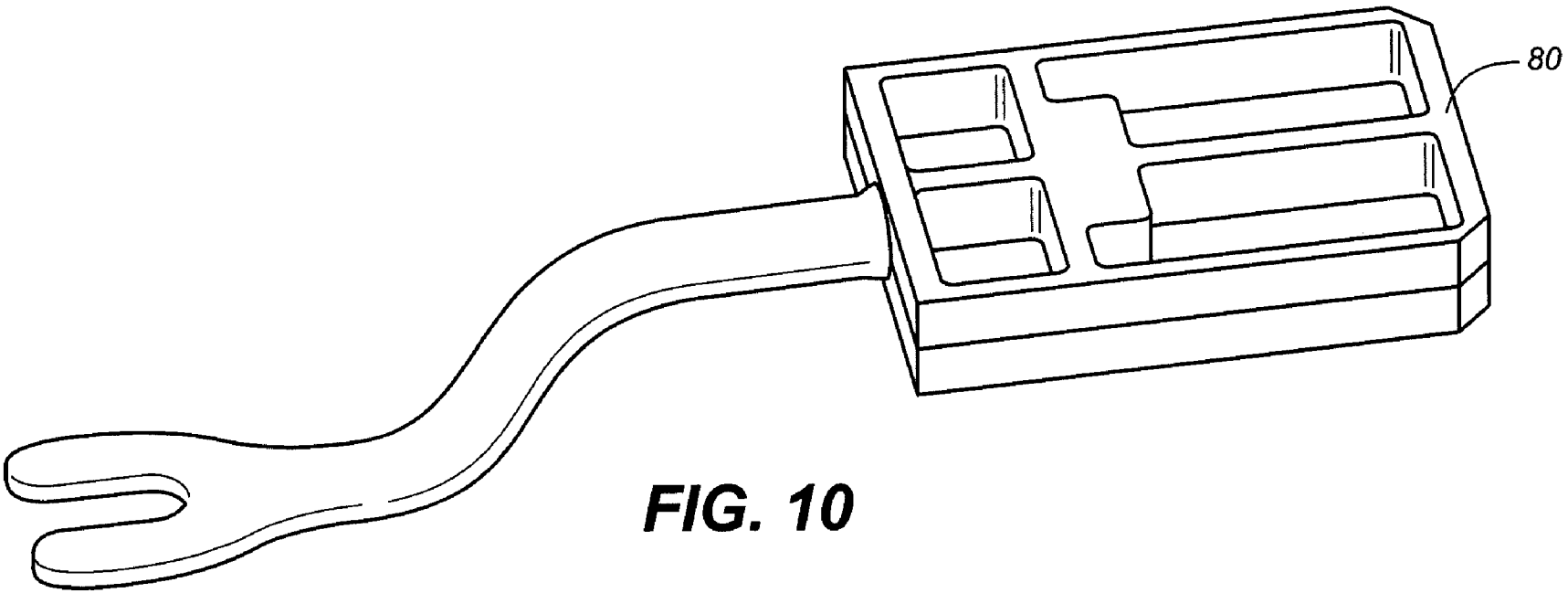
FIG. 10 is a view of a fork tool wafer for use in conjunction with the messenger line accessory of FIG. 9.

FIG. 9 is a view of a messenger line accessory 70; and FIG. 10 is a view of a fork tool wafer 80 for use in conjunction with the messenger line accessory.

An accessory could be any hardware, product, or device that is used in conjunction with the inventive apparatus, for example a messenger line. An important capability of the inventive apparatus is allowing the user to thread line, cord, cable, rope or chain through eyebolts across a distance without the use of a ladder. The messenger line 70 works in conjunction with a fork tool wafer 80. It is a short length of steel, weighted at one end, and at the other end is a small oval eyebolt that attaches to a length of nylon string. Just forward of the oval eyebolt is a flange designed to accept the tines of the fork tool wafer. The user inserts the fork tool wafer 80 into the core. The messenger line 70 is attached via its flange onto the fork tool wafer. The operator advances the messenger line up to the first eyebolt in a course of eyebolts to be threaded. As the messenger is subsequently threaded through each succeeding eyebolt, the fork tool is pulled down—releasing the tines from the messenger line flange, and the messenger drops down to the operator bringing the nylon string with it. The operator reattaches the messenger to the fork tool and advances it back up to the next eyebolt to be threaded; on and on through the entire course of pre-installed eyebolts. At the last eyebolt, the operator attaches the opposite end of the nylon string to whatever line, cable or cord is desired to be threaded through the eyebolts and the operator gently pulls from the opposite side of the course threading the line, cord or cable through each eyebolt until it reaches him at the opposite end of the course. The apparatus may be used to facilitate the poling and threading of the line with the use of various wafers to keep the line from binding at any point along the course.

A motorizing adapter is a simple kit that allows the user to attach a drill motor to a given extension pole thus providing electric locomotion. The motorizing adapter may consist of three basic components: a hand grip (approximately 8" long) that comes in two pieces, a drill adapter, and a sleeve (approximately 8" long as well). The drill adapter is a small metal piece with very specific geometry, consisting of a shank at one end that may be chucked up to any drill motor, and its opposite end is a large hexagonal shape that seats into the end of the hand grip and the two halves of the hand grip are screwed down tight over the drill adapter securing it to the end of the pole. The drill adapter and hand grip may be assembled by the operator in this manner prior to operation or poles may be manufactured already fitted with the adapter. For installation, the drill adapter is placed in one half of the hand grip and is placed on the end of the pole. The other half of the hand grip is then attached to its mate and secured with the aid of four nuts and screws that seat into countersunk bosses in the grip thus securing the grip onto the end of the pole and the drill adapter inside the end of the grip. The sleeve is then slid over the pole where it may be moved up and down and freely rotates. Finally, the core portion is installed at the opposite end of the pole and a wafer with the desired piece of corresponding hardware is inserted. The user is now ready to install. Operation is as follows: a drill motor is chucked up to the drill adapter shank. The user places one hand on the drill with a finger at the trigger position, and the other hand on the rotating sleeve. The user advances the apparatus to the desired installation surface, and then activates the drill motor which spins the pole rotating inside the sleeve, and the piece of hardware is installed. When the piece of hardware is fully threaded, the user releases the trigger on the drill, and changes the position of the other hand from the rotating sleeve to the pole for better grip. Then, the user gently pulls down on the core releasing the wafer from the installed piece of hardware. Installation is complete.

It is important to note that the inventive wafer technology is a new quick attach and release system, an attachment system that may supercede many forms of previous attachment systems, and thousands of different devices may be adapted to wafer technology for quick interchange. For the purposes of the device described herein, with all its various attachments and tools described herein, it should not be limited in any way to the application of other attachments, tools, or devices, which may be adapted to the inventive apparatus through variations in the future.

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

What is claimed is:

1. An extension apparatus for hardware and tools, said apparatus comprising:

a core portion having a top, a bottom, and an internal cavity, said bottom including means for attachment to an extension device;

a wafer member including a bed for releasable capture of a hardware article, said wafer member slidably engaged in said core portion internal cavity between a first hardware loading and releasing position and a second hardware securing position; and a locking tab on said core portion to secure said wafer member in said core portion in said first hardware loading and releasing position, wherein a hardware article may be placed in said wafer member when said wafer member is in said first hardware loading and releasing position, said wafer member moved to said second hardware securing position in said core portion internal cavity to secure the hardware article within said core portion and enable installation of the hardware article to a structure, and said wafer member moved back to said first hardware loading and releasing position to enable release of the installed hardware article from said wafer member.

2. The extension apparatus for hardware and tools of claim 1 wherein said means for attachment to an extension device comprises a female ACME thread.

3. The extension apparatus for hardware and tools of claim 1 wherein said extension device comprises an extension pole.

4. The extension apparatus for hardware and tools of claim 1 wherein said wafer member includes a depression to engage said core portion locking tab.

5. The extension apparatus for hardware and tools of claim 1 wherein the piece of hardware includes a shank, and said wafer member further includes a choke point for capture of the shank.

6. The extension apparatus for hardware and tools of claim 1 wherein the hardware article is taken from the group consisting of eyebolts, hooks, right-angle hooks, and push pins.

7. The extension apparatus for hardware and tools of claim 1 wherein said wafer member comprises a hardware extractor.

8. The extension apparatus for hardware and tools of claim 7 wherein said hardware extractor comprises a cavity with walls wide enough to fit over a piece of hardware.

9. An extension apparatus for hardware and tools, said apparatus comprising:

a core portion having a top, a bottom, and an internal cavity, said bottom including means for attachment to an extension device; and a wafer member comprising an attachment device for a stud sensor including a pivot arm connected to a shoe for capture of a stud sensor, said wafer member adapted for releasable capture in said core portion internal cavity, said wafer member adapted to selectively secure an article to said core portion for extension by an extension device to perform a task.

* * * * *